US011359438B2

(12) United States Patent
Batarseh

(10) Patent No.: US 11,359,438 B2
(45) **Date of Patent: *Jun. 14, 2022**

(54) HIGH POWER LASER COMPLETION DRILLING TOOL AND METHODS FOR UPSTREAM SUBSURFACE APPLICATIONS

(71) Applicant: Saudi Arabian Oil Company, Dhahran (SA)

(72) Inventor: Sameeh Issa Batarseh, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 16 days.

This patent is subject to a terminal disclaimer.

(21) Appl. No.: 17/154,508

(22) Filed: Jan. 21, 2021

(65) Prior Publication Data

US 2021/0164294 A1 Jun. 3, 2021

Related U.S. Application Data

(63) Continuation of application No. 16/156,657, filed on Oct. 10, 2018, now Pat. No. 10,941,618.

(51) Int. Cl.
*E21B 7/15* (2006.01)
*E21B 7/20* (2006.01)
(Continued)

(52) U.S. Cl.
CPC ..... *E21B 7/15* (2013.01); *E21B 7/20* (2013.01); *E21B 17/1078* (2013.01);
(Continued)

(58) Field of Classification Search
CPC ... E21B 7/15; E21B 7/20; E21B 7/205; E21B 7/065; E21B 7/061; E21B 7/208;
(Continued)

(56) References Cited

U.S. PATENT DOCUMENTS 3,828,854 A 8/1974 Templeton et al.
4,090,572 A 5/1978 Welch
(Continued)

FOREIGN PATENT DOCUMENTS

CN 203081295 U 7/2013
CN 203334954 U 12/2013
(Continued)

OTHER PUBLICATIONS

Anonymous"Laser Applications Laboratory—Laser Oil & Gas Well Drilling" Argonne National Laboratory, Nuclear Engineering Division, http://www.ne.anl.gov/facilities/lal/laser_drilling.html, printed Feb. 5, 2013, 2 pages.
(Continued)

*Primary Examiner* — George S Gray
(74) *Attorney, Agent, or Firm* — Bracewell LLP; Constance G. Rhebergen; Eleanor L. Tyson

(57) ABSTRACT

A method of drilling a wellbore that traverses a formation, the method comprising the steps of inserting a one-stage drilling tool into the wellbore, the one-stage drilling tool comprising a laser head configured to produce a drilling beam, a completion sheath configured to line the wellbore, and a centralizer configured to support the completion sheath within the wellbore, operating the laser head to produce the drilling beam, wherein the drilling beam comprises a laser, wherein the drilling beam has a divergent shape comprising a base at a distance from a front end of the laser head and an apex proximate to the front end of the laser head, wherein a diameter of the base of the drilling beam is greater than a diameter of the one-stage drilling tool, and drilling the formation with the drilling beam, wherein the laser of the drilling beam is operable to sublimate the formation.

20 Claims, 7 Drawing Sheets

(51) Int. Cl.

| | |
|---|---|
| ***E21B 17/10*** | (2006.01) |
| ***E21B 41/00*** | (2006.01) |
| ***E21B 43/117*** | (2006.01) |
| ***E21B 17/00*** | (2006.01) |
| ***E21B 21/16*** | (2006.01) |
| ***E21B 47/07*** | (2012.01) |

(52) U.S. Cl.
CPC ..... *E21B 41/0078* (2013.01); *E21B 43/117* (2013.01); *E21B 17/003* (2013.01); *E21B 21/16* (2013.01); *E21B 47/07* (2020.05)

(58) Field of Classification Search
CPC ..... E21B 7/14; E21B 17/1078; E21B 17/003; E21B 41/0078; E21B 43/117; E21B 21/16; E21B 21/00; E21B 47/07; E21B 29/06; E21B 10/66
See application file for complete search history.

(56) References Cited

U.S. PATENT DOCUMENTS

| | | | | |
|---|---|---|---|---|
| 4,227,582 | A | 10/1980 | Price | |
| 4,282,940 | A | 8/1981 | Salisbury et al. | |
| 6,705,413 | B1 * | 3/2004 | Tessari | E21B 7/208 175/22 |
| 6,755,262 | B2 | 6/2004 | Parker | |
| 6,870,128 | B2 | 3/2005 | Kobayashi et al. | |
| 6,880,646 | B2 | 4/2005 | Batarseh | |
| 6,888,097 | B2 | 5/2005 | Batarseh | |
| 7,490,664 | B2 | 2/2009 | Skinner et al. | |
| RE42,877 | E * | 11/2011 | Lirette | E21B 17/07 175/57 |
| 8,820,434 | B2 | 9/2014 | Zediker et al. | |
| 8,826,973 | B2 | 9/2014 | Moxley et al. | |
| 8,890,434 | B2 | 11/2014 | Shimomura | |
| 8,944,186 | B2 | 2/2015 | Kocis et al. | |
| 9,284,783 | B1 | 3/2016 | Faircloth et al. | |
| 9,410,376 | B2 | 8/2016 | Wang et al. | |
| 9,677,339 | B2 | 6/2017 | Linetskiy et al. | |
| 9,719,302 | B2 | 8/2017 | Linyaev et al. | |
| 9,784,037 | B2 | 10/2017 | Grubb et al. | |
| 9,903,171 | B2 | 2/2018 | Linetskiy et al. | |
| 2007/0267220 | A1 | 11/2007 | Magiawala et al. | |
| 2012/0074110 | A1 | 3/2012 | Zediker et al. | |
| 2012/0118568 | A1 | 5/2012 | Kleefisch et al. | |
| 2013/0008659 | A1 | 1/2013 | Schultz et al. | |
| 2014/0231147 | A1 * | 8/2014 | Bozso | E21B 7/14 175/73 |
| 2014/0299375 | A1 * | 10/2014 | Bozso | E21B 33/138 175/17 |

FOREIGN PATENT DOCUMENTS

| | | | |
|---|---|---|---|
| GB | 2420135 | A | 5/2006 |
| WO | 2004009958 | A1 | 1/2004 |
| WO | 2013051611 | A1 | 4/2013 |

OTHER PUBLICATIONS

Bakhtbidar et al."Application of Laser Technology for Oil and Gas Wells Perforation" SPE/IADC Middle East Drilling Technology Conference and Exhibition, SPE/IADC 148570, Muscat, Oman, Oct. 24-26, 2011, 12 pages.

Batarseh et al."Deep hole penetration of rock for oil production using Ytterbium fiber laser" SPIE Proceedings, Conference vol. 5448, High-Power Laser Ablation V, 818, Taos, New Mexico, Sep. 20, 2004, 9 pages.

Batarseh et al. "Innovation in Wellbore Perforation Using High-Power Laser" International Petroleum Technology Conference, IPTC 10981, Doha, Qatar, Nov. 21-23, 2005, 7 pages.

Batarseh et al."Well Perforation Using High-Power Lasers" SPE Annual Technical Conference and Exhibition, SPE 84418, Denver, Colorado, Oct. 5-8, 2003, 10 pages.

International Search Report and Written Opinion for related PCT application PCT/US2014/036553 dated Feb. 18, 2015.

International Search Report and Written Opinion for related PCT application PCT/US2019/055588 dated Jan. 10, 2020.

* cited by examiner

HIGH POWER LASER COMPLETION DRILLING TOOL AND METHODS FOR UPSTREAM SUBSURFACE APPLICATIONS

CROSS-REFERENCE TO RELATED APPLICATIONS

This patent application is a continuation of U.S. Non-Provisional patent application Ser. No. 16/156,657 filed on Oct. 10, 2018. For purposes of United States patent practice, the non-provisional application is incorporated by reference in its entirety.

TECHNICAL FIELD

Disclosed are apparatus and methods related to well drilling and completion. Specifically, disclosed are apparatus and methods related to the use of lasers in downhole applications.

BACKGROUND

In a first step of the drilling stage in conventional well construction, a mechanical drill bit is used to drill into the formation at an interval of approximately 30 feet. In a second step, the 30 foot section is cased with sections of steel pipe. The steel pipes of the casing can be cemented into place. The steps of drilling and casing can be repeated in 30 foot intervals until the desired well length is reached.

Once the desired well length is reached, the completion stage begins by lowering a shaped charged gun into the wellbore. The shaped charged gun creates holes and tunnels fluidly connecting the interior of steel pipes of the casing with the formation and allowing reservoir fluids to flow from the formation into the wellbore. Shaped charged guns can be effective at perforating the casing, but cannot provide precision perforation or can change orientation based on information about the wellbore.

In conventional well construction, the need to create holes or cut windows in the casing after the casing has been installed in the wellbore can be achieved with mechanical tools such as milling. Milling uses a special tool to grind away metal. Mechanical means to produce holes and windows are time consuming and not accurate.

The drilling and completion stages in conventional well construction are time consuming and costly. Alternate approaches that allow for greater flexibility are desired. Production, producing fluid from the formation to the surface, can only begin after the drilling and completion sages are finished.

SUMMARY

Disclosed are apparatus and methods related to the use of lasers downhole. Specifically, disclosed are apparatus and method related to laser control in downhole applications.

In a first aspect, a method of drilling a wellbore that traverses a formation is provided. The method includes the steps of inserting a one-stage drilling tool into the wellbore, the one-stage drilling tool includes a laser head configured to produce a drilling beam, a completion sheath configured to line the wellbore, and a centralizer configured to support the completion sheath within the wellbore. The method further includes the steps of operating the laser head to produce the drilling beam, where the drilling beam includes a laser, where the drilling beam has a divergent shape that includes a base at a distance from a front end of the laser head and an apex proximate to the front end of the laser head, where a diameter of the base of the drilling beam is greater than a diameter of the one-stage drilling tool, and drilling the formation with the drilling beam, where the laser of the drilling beam is operable to sublimate the formation.

In certain aspects, the method further includes the step of propelling the one-stage drilling tool into the formation by a mode of movement selected from the group consisting of orientation nozzles, coiled tubing, and combinations of the same, where the drilling beam is configured to continuously sublimate the formation as the one-stage drilling tool is propelled into the formation. In certain aspects, the method further includes the steps of producing a laser beam in a laser unit, the laser unit positioned on a surface of earth near the wellbore, conducting the laser beam from the laser unit to the laser head through an isolation cable that includes a fiber optic cable configured to conduct the laser beam from the laser unit to the laser head, where the isolation cable runs through the completion sheath from the laser unit to the laser head, and manipulating the laser beam in a laser assembly of the laser head to produce the drilling beam, where the laser assembly includes one or more lenses. In certain aspects, the isolation cable further includes inflatable packers configured to stabilize the isolation cable in the completion sheath. In certain aspects, the method further includes the steps of reaching a predetermined well length, concluding operation of the drilling beam, detaching an isolation cable from the laser head, where the isolation cable includes a fiber optic cable, and retrieving the isolation cable from the completion sheath, where the completion sheath and laser head remain fixed in the wellbore. In certain aspects, the method further includes the step of perforating the completion sheath with a perforation method, where the perforation method can be selected from the group consisting of a laser and shaped charges. In certain aspects, the method further includes the steps of activating one or more orientation nozzles situated around a laser assembly of the laser head by discharging a control fluid, discharging the control fluid from one or more of the orientation nozzles, where the discharge of the control fluid is configured to provide thrust to the one-stage drilling tool, and moving the laser head, where the thrust provided by the control fluid is operable to move the one-stage drilling tool in a corresponding direction. In certain aspects, the corresponding direction can be selected from the group consisting of relative to a central axis, into the formation away from the surface, and combinations of the same.

In a second aspect, an apparatus for drilling a wellbore in a formation with a drilling beam is provided. The apparatus includes a laser head configured to produce the drilling beam, laser head includes a laser assembly configured to manipulate a laser beam to produce the drilling beam, and orientation nozzles configured to control the laser head. The apparatus further includes a completion sheath physically connected to the laser head and configured to maintain wellbore integrity. And a centralizer physically connected to the completion sheath and configured to reduce movement of the apparatus. The drilling beam is configured to sublimate the formation to produce the wellbore.

In certain aspects, the apparatus further includes a laser unit configured to produce a laser beam, an isolation cable physically connected to the laser unit and to the laser head such that the isolation cable runs through the completion sheath from the laser head to the laser unit, where the isolation cable includes a fiber optic cable configured to conduct the laser beam from the laser unit to the laser head, and a protective layer physically surrounding the fiber optic cable. The protective layer is configured to protect the fiber optic cable. The apparatus further includes the laser assembly physically connected to the completion sheath. The laser assembly is configured to manipulate the laser beam to produce the drilling beam, where the laser assembly includes one or more lenses. In certain aspects, the isolation cable further includes inflatable packers configured to stabilize the isolation cable in the completion sheath. In certain aspects, the laser assembly includes a focused lens configured to focus the laser beam to produce a focused beam, a control optics configured to manipulate the focused beam to produce a shaped beam that includes a shape selected from the group consisting of a divergent shape, a focused shape, a collimated shape, and combinations of the same. The laser assembly further includes a cover lens configured to protect the shaped beam from debris and to allow the shaped beam to pass without manipulating the shaped beam. In certain aspects, the laser assembly further includes one or more purging nozzles positioned externally on the laser assembly, the purging nozzles configured to introduce a purge fluid to the wellbore, where the purge fluid is operable to clear debris from the cover lens, a temperature sensor positioned externally on the laser assembly, the temperature sensor configured to provide real time monitoring of a temperature at the laser head, and an acoustic sensor positioned at a front end of the laser assembly, the acoustic sensor configured to provide velocity measurements. In certain aspects, the laser assembly includes a splitter configured to separate the laser beam into multiple beams, where the splitter includes a prism, and an exit lens configured to manipulate a straight-through beam to produce the drilling beam. In certain aspects, the completion sheath is selected from the group consisting of piping, casing, liner, and combinations of the same. In certain aspects, each of the orientation nozzles is configured to discharge a control fluid operable to orient the one-stage drilling tool relative to a central axis. In certain aspects, each of the orientation nozzles is configured to discharge a control fluid, where the discharge of the control fluid is configured to move the one-stage drilling tool into the formation. In certain aspects, the apparatus further includes coiled tubing configured to propel the one-stage drilling tool into the formation, where the drilling beam is configured to continuously sublimate the formation as the one-stage drilling tool is propelled into the formation.

BRIEF DESCRIPTION OF THE DRAWINGS

These and other features, aspects, and advantages of the scope will become better understood with regard to the following descriptions, claims, and accompanying drawings. It is to be noted, however, that the drawings illustrate only several embodiments and are therefore not to be considered limiting of the scope as it can admit to other equally effective embodiments.

Figure 1:
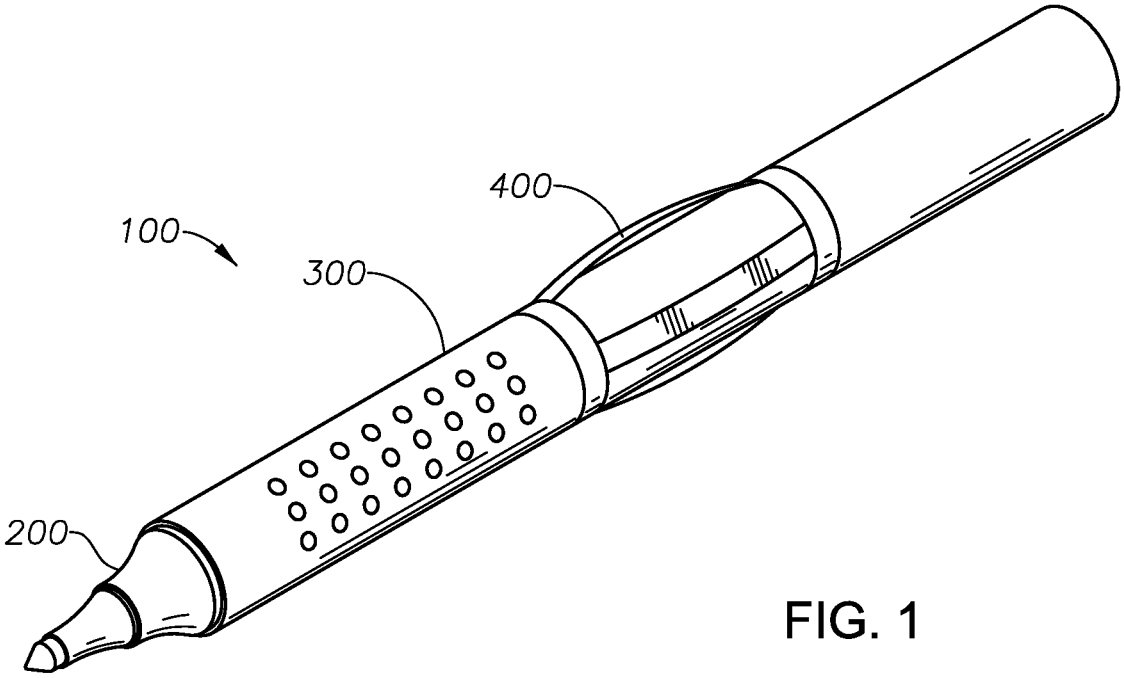
FIG. 1 is a pictorial view of an embodiment of the one-stage drilling tool.

In the accompanying Figures, similar components or features, or both, may have a similar reference label.

DETAILED DESCRIPTION

While the scope of the apparatus and method will be described with several embodiments, it is understood that one of ordinary skill in the relevant art will appreciate that many examples, variations and alterations to the apparatus and methods described here are within the scope and spirit of the embodiments.

Accordingly, the embodiments described are set forth without any loss of generality, and without imposing limitations, on the embodiments. Those of skill in the art understand that the scope includes all possible combinations and uses of particular features described in the specification.

Methods and apparatus described here are directed to drilling wellbores and installing well completion parts in the drilled wellbore in one step. The one-stage drilling tool combines the steps of drilling and completion.

Advantageously, the methods and apparatus of the one-stage drilling tool reduce the overall time required to reach the production stage of a formation. Advantageously, the methods and apparatus for one-stage drilling and well completion avoid the need for tripping and reduce the time required for the completion stage. Advantageously, the methods and apparatus for one-stage drilling reduce costs by simultaneously drilling the wellbore and delivering completion parts as compared to the conventional process which requires drilling and completion to occur in stages. Advantageously, the use of laser drilling can reduce or eliminate incidental damage to the formation or the wellbore because the laser can be focused to provide targeted damage to the formation. Advantageously, the methods and apparatus of the one-stage drilling tool can drill a wellbore, perforate a formation or a casing, provide information regarding the formation and wellbore environment, and deliver and install downhole completion tools. Advantageously, the apparatus and methods of the one-stage drilling tool can produce a precision wellbore with uniform shape allowing for a close fit between the wellbore and the completion sheath. Advantageously, one-stage drilling tool can be used to create wellbores of greater diameter than the tool.

As used here, "completion" or "completion stage" refers to the group of activities performed to prepare a drilled wellbore for the production stage. Activities can include, but are not limited to, identifying zones of interest, cementing, installing equipment, such as packing and tubulars, perforating the casing and formation, installing control systems, and combinations of the same. Completion can begin in one part of the well while drilling continues in another, thus drilling and completion can overlap and not be distinct stages when considering the wellbore as a whole.

As used here, "debris" refers to dust, vapor, particulate matter, cuttings, and other detritus.

As used here, "in-situ" refers to a position within the formation or wellbore. By way of example, a test performed in-situ would be performed in the wellbore.

As used here, "opening" refers to perforations, holes, tunnels, notches, slots, windows, and combinations of the same in the materials of the wellbore and the surrounding rock formations. The openings can have dimensions along the two-dimensional plane and a penetration depth. As used here, "perforations" refers to openings that extend from the wellbore through the casing and cementing and into the rock formation that can have a penetration depth of up to 48 inches into the formation. As used here, "holes" refer to openings that extend from the wellbore through the casing and cementing. As used here, "tunnels" refer to openings that extend from the wellbore through the casing and cementing and into the rock formation that can have a penetration depth of up to 300 feet. As used here, "notches" refer to scratches on the rock or small scratches in an opening. As used here, "slots" refer to openings in the casing used for wellbore-formation communication during production such that fluid can flow from the formation to the wellbore through slots. As used here, "windows" refers to openings in the casing that can be used for drilling horizontal wells or other side wells from a wellbore.

As used here, "penetration depth" refers to the distance the opening extends into the formation as measured from the wellbore wall into the formation to the farthest point the opening penetrates the formation.

As used here, "production" or "production stage" refers to the stage following completion where fluids, for example oil and gas, flow from a formation to a wellbore and are captured at the surface. Typically, once a well is in production it can be considered to be making money.

As used here, "shape" of "shape of the opening" refers to the outline of the opening in the x-y plane perpendicular to the laser tool.

Referring to FIG. 1, an embodiment of a one-stage drilling tool 100 is described. One-stage drilling tool 100 contains laser head 200 attached to completion sheath 300, with centralizer 400 surrounding completion sheath 300. One-stage drilling tool 100 can be used in wellbores with diameters of 2 inches (5 centimeters (cm)), alternately diameters of 2 inches (5 cm) or greater, alternately diameters between 2 inches (5 cm) and 24 inches (61 cm), alternately diameters between 2 inches (5 cm) and 8 inches (20 cm), and alternately diameters between 8 inches (20 cm) and 24 inches (61 cm).

Figure 2A:
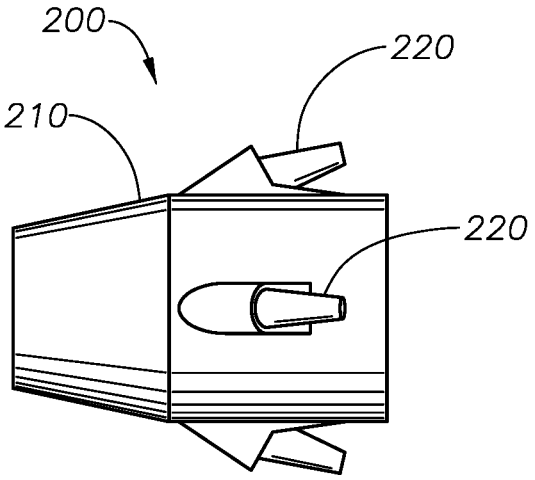
FIG. 2A is a pictorial view of an embodiment the laser head.

Laser head 200 can be any optical tool capable of manipulating a laser beam to produce a drilling beam for drilling. With reference to FIG. 2A, laser head 200 can include laser assembly 210 and orientation nozzles 220. Laser head 200 can be any material of construction that is resistant to the temperatures, pressures, and vibrations experienced in a wellbore. An embodiment of laser head 200 is described with reference to FIG. 2B.

Figure 2B:
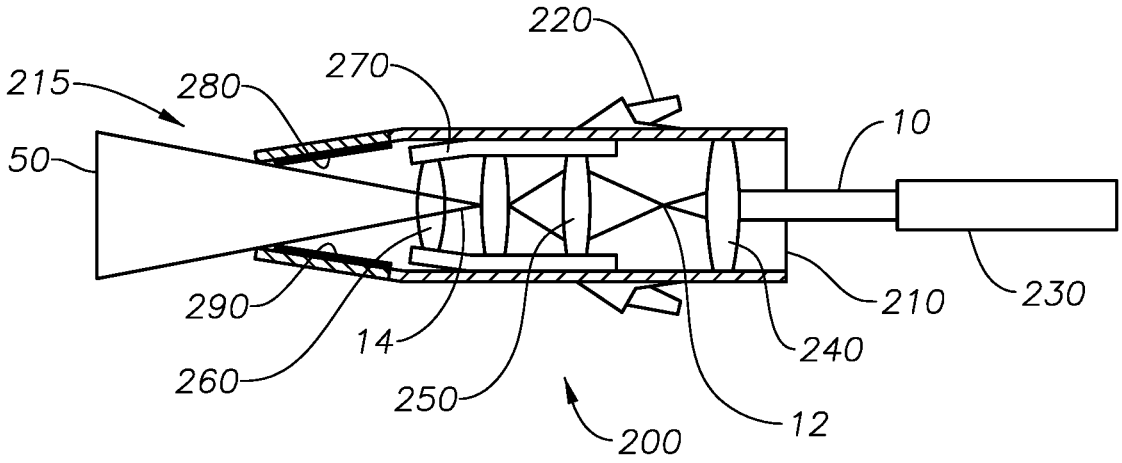
FIG. 2B is a sectional view of an embodiment of the laser head.

Referring to FIG. 2B, laser beam 10 exits isolation cable 230 and is introduced to laser assembly 210.

Laser beam 10 can be from any source capable of producing a laser and directing a laser downhole. In at least one embodiment, described with reference to FIG. 3, the source of laser beam 10 is laser unit 20 positioned on the surface of the earth near wellbore 30 in formation 40.

Laser unit 20 is in electrical communication with isolation cable 230. Laser unit 20 generates the power needed to penetrate formation 40, the power is conducted by isolation cable 230 to laser head 200, where the power is released from isolation cable 230 to laser head 200. Laser unit 20 can be any unit capable of producing a laser with a power between 500 watt (W) and 3000 W, alternately between 500 W and 2500 W, alternately between 500 W and 2000 W, alternately between 500 W and 1500 W, and alternately between 500 W and 1000 W. Laser unit 20 can be any type of laser unit capable of generating laser beams, which can be conducted through isolation cable 230. Laser unit 20 includes, for example, lasers of ytterbium, erbium, neodymium, dysprosium, praseodymium, and thulium ions. In accordance with an embodiment, laser unit 20 includes, for example, a 5.34-kW Ytterbium-doped multiclad fiber laser. In an alternate embodiment, laser unit 20 is any type of fiber laser capable of delivering a laser at a minimum loss of power. The wavelength of laser unit 20 can be determined by one of skill in the art as necessary to penetrate formation 40. Laser unit 20 can be part of a coiled tubing unit.

One-stage drilling tool 100 can drill wellbore 30 into formation 40. Formation 40 can include limestone, shale, sandstone, or other rock types common in hydrocarbon bearing formations. The particular rock type of formation 40 can be determined by experiment, by geological methods, or by analyzing samples taken from formation 40.

Returning to FIG. 2B, isolation cable 230 can be any kind of cable capable of protecting and delivering a laser beam through a wellbore. Isolation cable 230 can include a fiber optic cable surrounded by one or more protective layers. The protective layers can protect the fiber optic cable from a wellbore environment, including resistance to wellbore pressures and wellbore temperatures, and from physical damage, such as being scratched, bending, or breaking.

After exiting isolation cable 230, laser beam 10 passes through focused lens 240. Focused lens 240 can be any type of optical lens capable of focusing laser beam 10. Focused lens 240 can be any type of material capable of producing a focusing lens. Examples of materials suitable for use as focused lens 240 can include glass, plastic, quartz, and crystal. Focused lens 240 can focus laser beam 10 to produce focused beam 12. Focused beam 12 can be manipulated in focused lens 240 such that the shape, size, focus, and combinations of the same differs from laser beam 10. Focused beam 12 then passes through control optics 250 to produce shaped beam 14.

Control optics 250 can include one or more lenses designed to manipulate focused beam 12 to produce a desired shape of shaped beam 14. Shaped beam 14 can have any shape capable of being produced by a set of lenses. The lenses in control optics 250 can be of any material suitable for use in lenses that manipulate a laser beam. Examples of materials suitable for use in the one or more lenses of control optics 250 can include glass, plastic, quartz, and crystal. The shape of shaped beam 14 can be determined by the diameter and geometry of the wellbore desired. Examples of shapes that can be produced in shaped beam 14 include divergent shape, focused shape, collimated shape, and combinations of the same. The size and shape of shaped beam 14 can be preset based on the lenses used in control optics 250 and alternately the size and shape of shaped beam 14 can be manipulated after one-stage drilling tool is in the wellbore by rearranging the lenses of control optics 250 within laser assembly 210. Rearranging the lenses can include the distance between the lenses and the angle of the lenses. Rearranging the lenses in control optics 250 can be done electrically or hydraulically. The controls can be at the surface. In at least one embodiment, the lenses in control optics 250 can be mounted on a threaded rod and the threaded rod can be hydraulically controlled. Rearranging the lenses in control optics 250 can alter the shape of shaped beam 14 without the need for further manipulation. Rearranging the lens in control optics 250 can be done after the tool is deployed downhole.

Figure 4A:
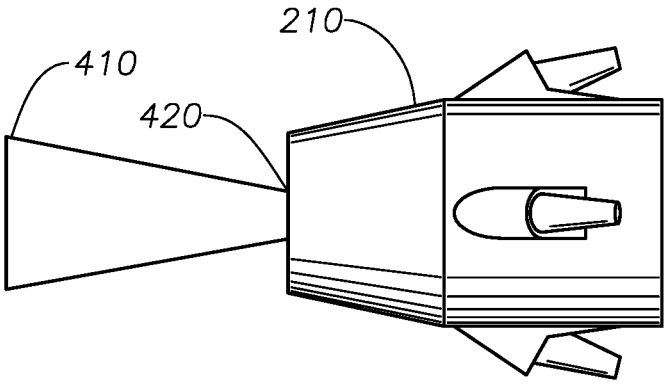
FIG. 4A is a pictorial representation of a shaped beam with a divergent shape.

FIG. 4A depicts a representation of a beam with a divergent shape with reference to FIGS. 2A and 2B. A divergent shape is a conical shaped beam, with base 410 and apex 420, where the diameter of base 410 of the cone is greater than apex 420. Base 410 can be at a distance from laser head 200, such that base 410 of the cone moves away from laser assembly 210. The distance from laser head 200 can be between 0.2 meters and two meters, alternately between 0.5 meters and two meters, and alternately between 1 meter and 1.5 meters. In at least one embodiment, the distance from laser head 200 is 1 meter. Apex 420 can extend from and be proximate to laser head 200. The diameter of base 410 can be greater than the diameter of one-stage drilling tool 100, including greater than each of the individual components of one-stage drilling tool 100. In at least one embodiment, the diameter of base 410 can result in drilling a hole larger than one-stage drilling tool 100. In at least one embodiment, a laser beam with a divergent shape can be used to drill a hole in the formation, allowing one-stage drilling tool to continue to travel further into the formation away from the surface. In at least one embodiment, control optics 250 can control the diameter of base 410 relative to the diameter of apex 420. In at least one embodiment, the distance between the lenses in control optics 250 can determine the diameter of base 410 relative to the diameter of apex 420.

Figure 4B:
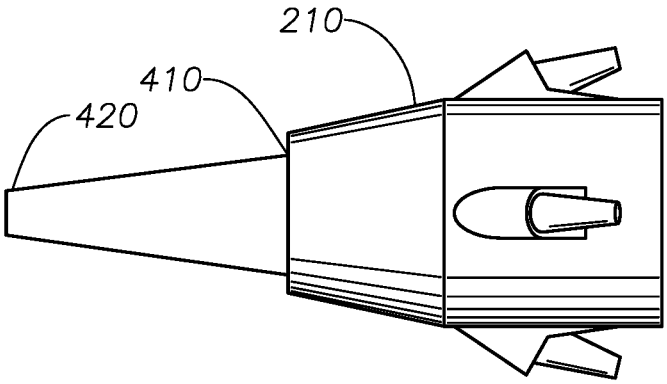
FIG. 4B is a pictorial representation of a shaped beam with a focused shape.

FIG. 4B depicts a representation of a beam with a focused shape FIGS. 2A and 2B. A focused shape is a conical shaped beam, where apex 420 of the cone moves away from laser assembly 210, such that the hole is smaller than the one-stage drilling tool 100. A laser beam with a focused shape can be used to perforate the wellbore. In at least one embodiment, a laser beam with a focused shape can be used to weaken the formation by perforating the formation or breaking the rocks and then a laser beam with a divergent shape can be used to drill the formation. In at least one embodiment, control optics 250 can control the diameter of base 410 relative to the diameter of apex 420. In at least one embodiment, the distance between the lenses in control optics 250 can determine the diameter of base 410 relative to the diameter of apex 420.

Figure 4C:
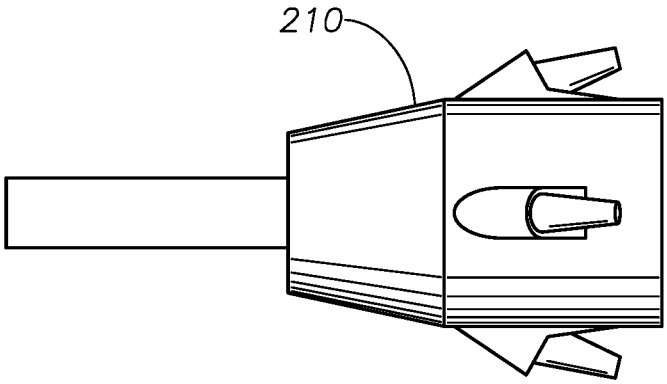
FIG. 4C is a pictorial representation of a shaped beam with a collimated shape.

FIG. 4C depicts a representation of a beam with a collimated shape with reference to FIGS. 2A and 2B. A collimated shape is a beam that maintains a constant diameter upon exiting laser assembly 210. A collimated shape can be used to drill a straight hole that can reach its target without the need for one-stage drilling tool 100 to move. In at least one embodiment, the diameter of shaped beam 14 can be determined by the diameter of isolation cable 230 and can be further altered by rearranging the lenses of control optics 250.

Returning to FIG. 2B, shaped beam 14 exits control optics 250 and passes through cover lens 260. Cover lens 260 can be any type of lens designed to allow a laser beam to pass through without further manipulating the beam. Cover lens 260 can be of any material suitable for use in lenses that protect a laser tool. Examples of materials suitable for use in cover lens 260 can include glass, plastic, quartz, and crystal. Cover lens 260 can protect laser head assembly 210 from debris found or produced in the wellbore.

Laser assembly 210 can include purging nozzle 270, temperature sensor 280, and acoustic sensor 290. Purging nozzle 270 can introduce a purge fluid to the wellbore. Purging nozzle 270 can include one nozzle, alternately two nozzles, and alternately more than two nozzles, with each nozzle capable of introducing fluids to the wellbore. In at least one embodiment, laser assembly 210 includes two nozzles. Examples of the purge fluids can include gases, liquids, and combinations of the same. The choice of purge fluid can be determined based on the composition of the formation and the pressure in the wellbore. For example, a gaseous purge fluid can be used when reservoir pressure is sufficiently reduce such that a gaseous purge fluid can flow from the surface to the location in the wellbore. In at least one embodiment, the purge fluid discharged from purging nozzle 270 is nitrogen, because nitrogen is a non-reactive and non-damaging gas. The purge fluid discharged from purging nozzle 270 can provide a clear, unobstructed field from cover lens 260 to the formation, by removing debris from the path of shaped beam 14 and drilling beam 50. Advantageously, removing debris from the field increases the amount of energy delivered to the formation because debris absorbs energy. Additionally, removing debris from the field of the laser prevents the debris from forming a melt in the wellbore rather than vaporizing the material completely. Purging nozzle 270 can reduce or eliminate damage to laser assembly 210 by preventing debris from entering. Purging nozzle 270 can lie flush inside laser assembly 210, with the exit point positioned between cover lens 260 and the outlet of laser assembly 210, such that the physical nozzles do not obstruct the path of shaped beam 14 or drilling beam 50. The purge fluid can be delivered from the surface through tubing. In at least one embodiment, purging nozzle 270 can provide supersonic purging, where the velocity of the purge fluid exiting purging nozzle 270 exceeds the velocity of sound. Due to the velocity of supersonic purging, the purge fluid can travel farther.

Temperature sensor 280 can be any type of sensor capable of providing on-line, real time monitoring of the temperatures surrounding laser head 200. In at least one embodiment, temperature sensor 280 is a fiber optic sensor. Advantageously, the presence of temperature sensor 280 can protect laser head 200 by providing feedback to a surface control system, such as laser unit 20. In at least one embodiment, temperature sensor 280 can provide real time monitoring of the temperature surrounding laser head 200, such that if the temperatures exceed an overheating threshold, the drilling rate can be reduced or an increased amount of fluid can be released from purging nozzles 270, for the purpose of reducing the temperature. Laser assembly 210 can include one or more of temperature sensor 280.

Acoustic sensor 290 can be any type of sensor capable of providing velocity measurements useful for predicting the strength of the formation surrounding the wellbore. Acoustic sensor 290 can also provide acoustic video and acoustic images in lieu of regular cameras which cannot be used in a wellbore environment. In at least one embodiment, acoustic sensor 290 is one or more acoustic transducers. Acoustic transducers can send and receive sound waves and can be electrically connected to the surface unit. In at least one embodiment, acoustic sensor 290 is positioned at front end 215 of laser head 200.

Shaped beam 14 can exit laser head 200 at front end 215 as drilling beam 50. Drilling beam 50 having a shape that can interact with the formation. In at least one embodiment, drilling beam 50 has a divergent shape and can sublimate the formation to produce a wellbore with a diameter greater than one-stage drilling tool 100.

Figure 2C:
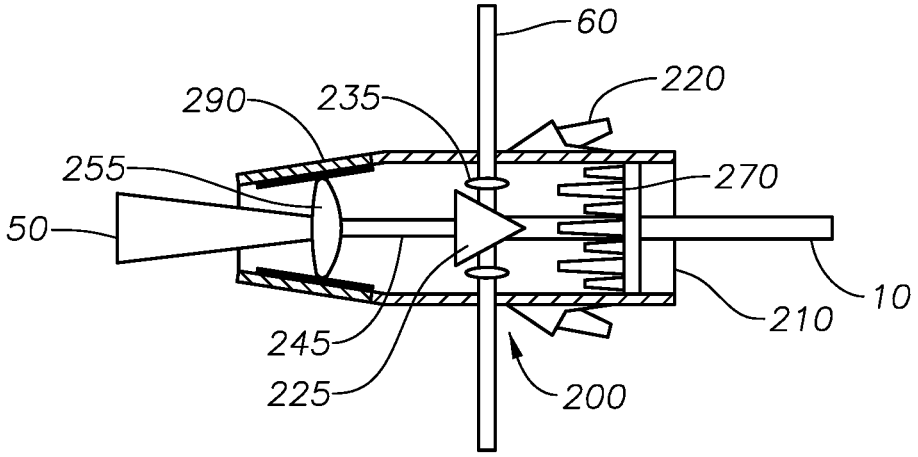
FIG. 2C is a sectional view of an embodiment of the laser head.

An alternate embodiment of laser head 200 is described with reference to FIG. 2C. Laser beam 10 enters laser assembly 210. Laser beam 10 is introduced to splitter 215. Splitter 215 can be any type of unit capable of separation one laser beam into multiple beams. Splitter 215 can include prism 225 and lens 235. Prism 225 can separate the one laser beam into multiple beams and lens 235 can focus the separated beams. Splitter 215 can produce side beam 60 and alternately more than one side beam 60.

At least part of laser beam 10 can travel through splitter 215 as a straight-through beam. The straight-through beam can enter fiber 245. Fiber 245 can direct the straight-through beam from splitter 215 to exit lens 255. Fiber 245 can be any kind of fiber optic cable capable of directing and protecting a laser beam. Fiber 245 can have any diameter capable of being enclosed in laser head 200. Exit lens 255 can be any type of lens. Exit lens 255 can alter the shape of the straight-through beam, can alter the focus of the straight-through beam, can alter the collimation of straight-through beam, and combinations of the same. In at least one embodiment, exit lens 255 can be selected to produce the beam shapes described with reference to FIGS. 4A, 4B, and 4C. Exit lens 255 can protect the components of laser assembly 210 from debris.

Purging nozzles 270 can reduce the temperature of prism 225 and lens 235, and can remove debris from the interior of laser assembly 210.

Figure 5:
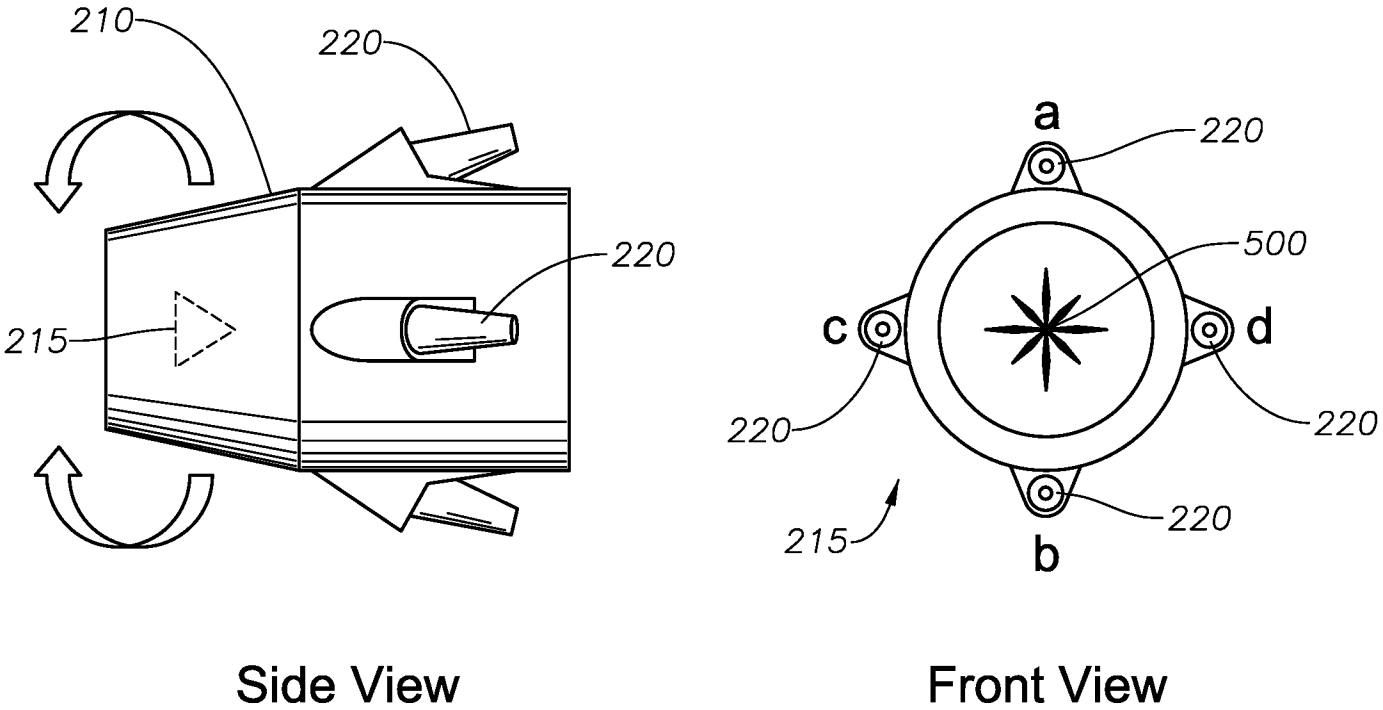
FIG. 5 is a pictorial view of an embodiment of the orientation nozzles.

Orientation nozzles 220 can be situated around laser assembly 210, as shown in FIG. 5. Orientation nozzles 220 can provide control of one-stage drilling tool 100. The opening of each of orientation nozzles 220 can be positioned away from front end 215. Orientation nozzles 220 can be evenly arranged around the diameter of laser assembly 210. There can be at least two nozzles, alternately at least three nozzles, alternately at least four nozzles, alternately more than 4 nozzles. Each of orientation nozzles 220 can be separately activated by discharging a control fluid. Examples of the control fluid can include gases and liquids. Examples of control fluids can include nitrogen, water, brine, and halocarbons. In at least one embodiment, the control fluid is nitrogen, a non-reactive, non-damaging gas. The control fluid can be supplied separately to each nozzle of orientation nozzles 220. The control fluid can be supplied from the surface to orientation nozzles 220 through tubing. Orientation nozzles 220 can orient or control one-stage drilling tool 100 by providing thrust to move one-stage drilling tool 100. Orientation nozzles 220 can orient one-stage drilling tool 100 relative to central axis 500 and alternately orientation nozzles 220 can move one-stage drilling tool 100 further into the formation away from the surface. Orientation nozzles 220 can operate independently from each other. The amount of thrust or movement can depend on the flow rate of the control fluid from orientation nozzles 220. For example, in the configuration depicted in FIG. 5, if only orientation nozzle 220 marked (a) is activated, laser head 200 would turn toward the south point on the compass marked around central axis 500. If all nozzles in orientation nozzles 220 were turned on at the same rate, the tool can move in a straight line further into the formation. Centralizer 400 can work with orientation nozzles 220 to align central axis 500 with the longitudinal axis extending through the center of wellbore 30.

Returning to FIG. 1, laser head 200 can be attached to completion sheath 300 by any conventional attachment means capable of attaching piping to a tool. Examples of attachment means for attaching laser head 200 to completion sheath 300 can include welds, threaded screws, clamps, fasteners, pins, clips, buckles, and combinations of the same. In at least one embodiment, laser head 200 and completion sheath 300 are permanently attached such that both laser head 200 and completion sheath 300 remain in the wellbore after completion and during production. In at least one embodiment, laser head 200 is designed to be disposable, such that by leaving laser head 200 in the wellbore, laser head 200 is discarded within the wellbore. In at least one embodiment, laser head 200 and completion sheath 300 are reversibly attached, such that the attachment means can be disengaged and laser head 200 can be removed through completion sheath 300.

Completion sheath 300 can include one or more types of hollow cylinders suitable for use to complete a wellbore by lining the wellbore, where a hollow cylinder is one where a cylinder wall defines a hollow interior. Completion sheath 300 can be used to maintain wellbore integrity, for sand control, and for combinations of the same. Maintaining wellbore integrity includes maintaining the shape and coherency of the wellbore to prevent the wellbore wall from collapsing into the wellbore. Completion sheath 300 can include piping, casing, liner, or combinations of the same. The materials of construction of completion sheath 300 can be determined by the nature of the wellbore and the target parameters needed for completion and production in the wellbore. The external diameter, internal diameter, and length of completion sheath 300 can be determined based on the diameter and length of the wellbore. In at least one embodiment, the cylinder wall of completion sheath 300 can be intact before being placed in the wellbore. In at least one embodiment, completion sheath 300 can include openings in the cylinder wall before being placed in the wellbore, where the openings allow fluid communication between the exterior of the cylinder wall and the hollow interior. In at least one embodiment, the openings can be formed in situ in the cylinder wall of an intact completion sheath 300 after completion sheath 300 is placed in the wellbore. In at least one embodiment, completion sheath 300 can be installed along the entire length of the wellbore. In at least one embodiment, completion sheath 300 can be installed in a specific zone in the wellbore, resulting in a partially cased wellbore.

Centralizer 400 can be any type of stabilizers capable of providing support to completion sheath 300. Centralizer 400 can reduce movement of one-stage drilling tool 100, center one-stage drilling tool 100 in wellbore 30, and combinations of the same. Reducing the movement of one-stage drilling tool 100 increases the stability of the tool. Examples of stabilizers suitable for use as centralizer 400 can include casing spacers, pipe spiders, or combinations of the same. Centralizer 400 can be any material of construction suitable for use in a downhole environment. Examples of materials of construction for centralizer 400 can include metals, plastics, and composite materials. Centralizer 400 can maintain one-stage drilling tool 100 in the center of the wellbore. Centralizer 400 can prevent completion sheath 300 of one-stage drilling tool 100 from getting stuck in the wellbore, as the one-stage drilling tool 100 sublimates the formation to create the wellbore or moves through the wellbore to the target zone. Centralizer 400 can be inflatable, such that when one-stage drilling tool 100 reaches the target zone in the formation, centralizer 400 can be inflated to stabilize one-stage drilling tool 100 within the wellbore. Centralizer 400 can be inflated by hydraulic mechanisms and mechanical mechanisms. Centralizer 400 can be used to stabilize one-stage drilling tool 100 as an alternative to cementing.

Figure 3:
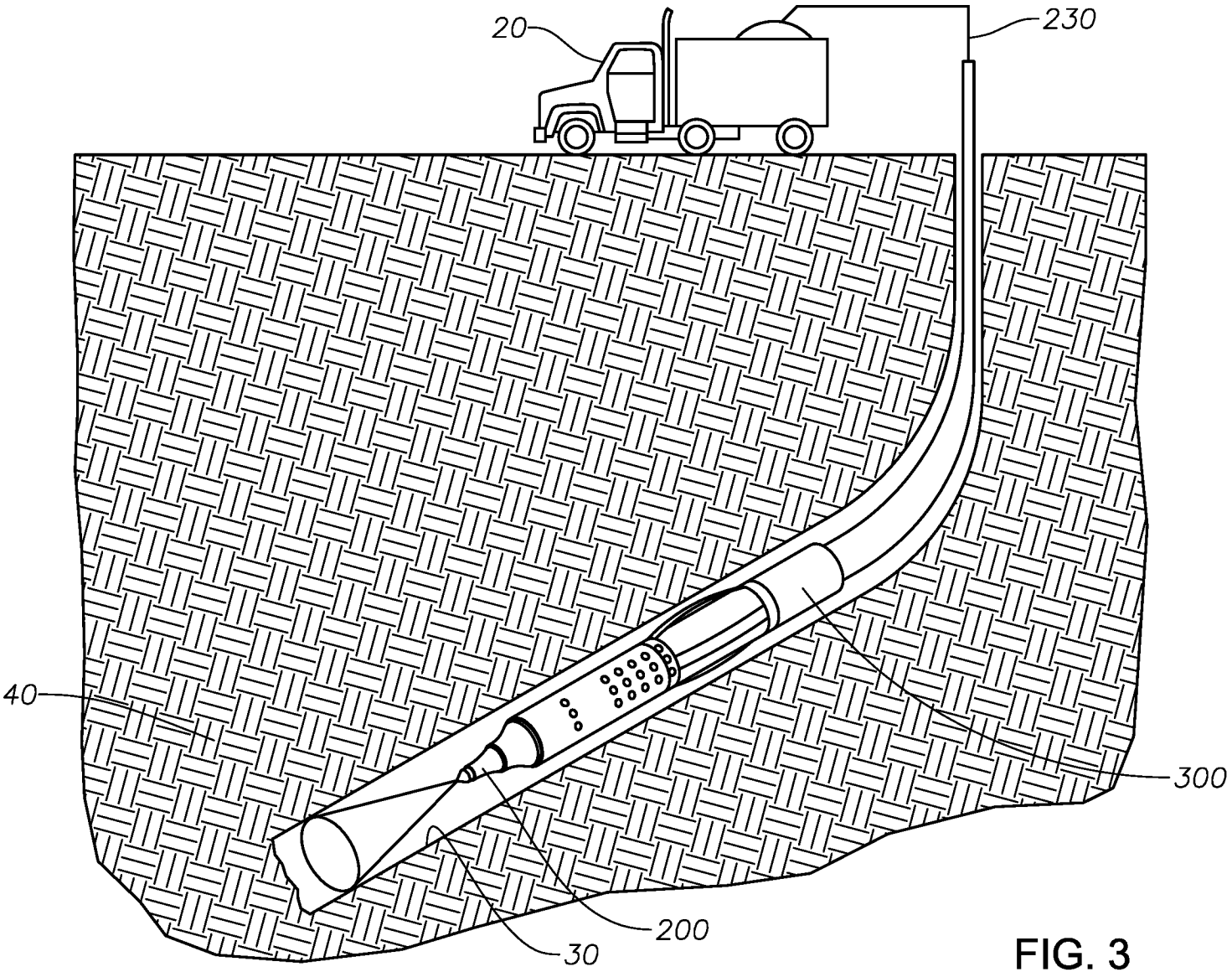
FIG. 3 is a pictorial representation of the one-stage drilling tool in a formation.
Figure 6:
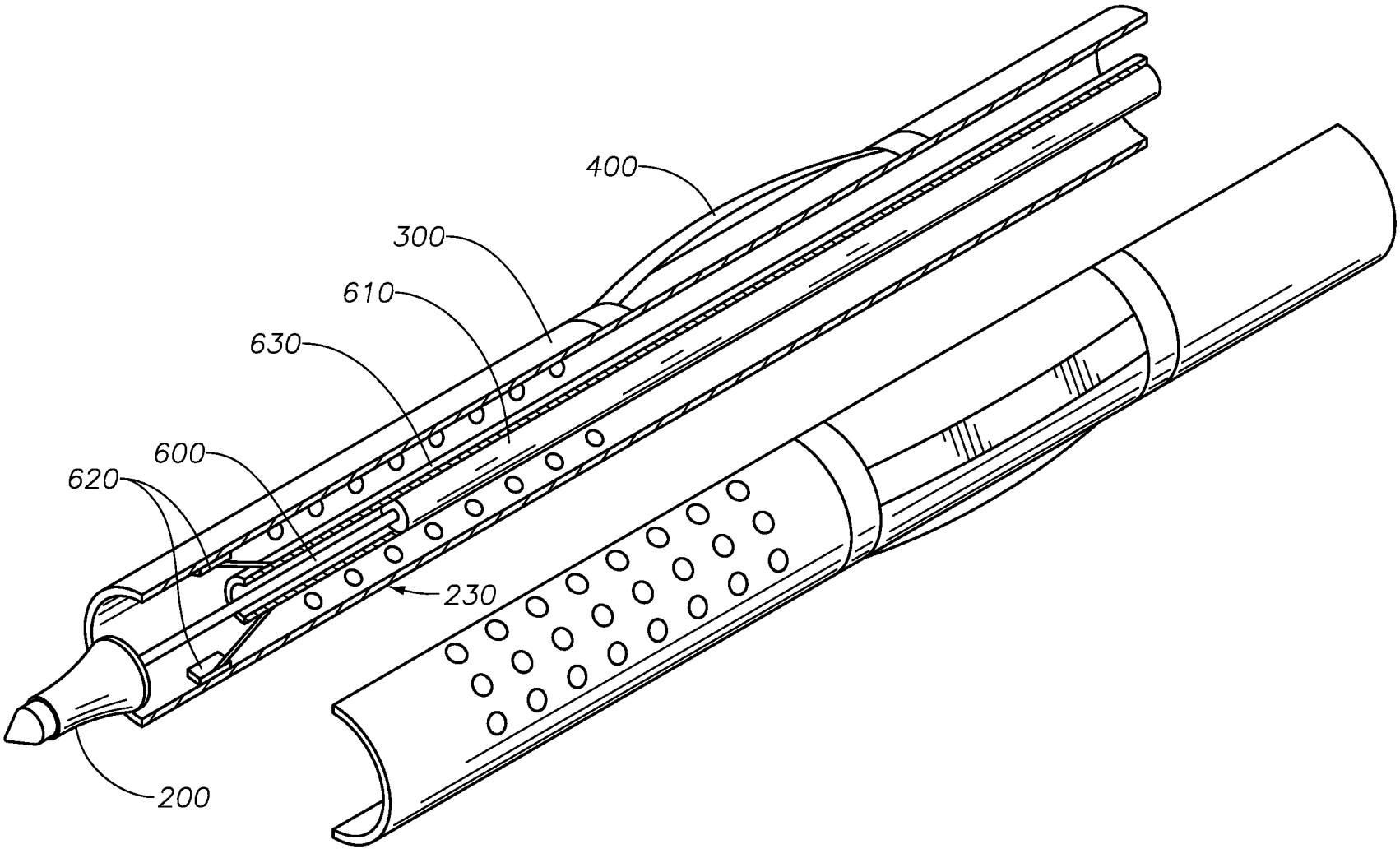
FIG. 6 is an exploded sectional view of an embodiment of a one-stage drilling tool.

One-stage drilling tool 100 can be further described with reference to FIG. 6 along with reference to FIG. 1, FIG. 2A, and FIG. 3. Isolation cable 230 can run from laser unit 20 to laser head 200 through completion sheath 300. Completion sheath 300 can help to protect isolation cable 230.

Isolation cable 230 can include fiber optic cable 600 and protective layer 610. Protective layer 610 can surround fiber optic cable 600. Protective layer 610 can protect fiber optic cable 600 as described with reference to FIG. 2B. Fiber optic cable 600 conducts the laser from laser unit 20 to laser head 200. Fiber optic cable 600 can be permanently attached to laser head 200 or can be detachable. In at least one embodiment, fiber optic cable 600 is detachable and can be withdrawn from completion sheath 300 after completion and before production begins. Fiber optic cable 600 can be attached to laser head 200 through any means that can be detached using quick connections, screws, plugs, or combinations of the same. In at least one embodiment, fiber optic cable 600 can be cut using a built in hydraulic blade.

Isolation cable 230 can be surrounded by coiled tubing 630, where the isolation cable is inside coiled tubing 630. Coiled tubing 630 can be any type of tubing suitable for use as coiled tubing in wellbores. Coiled tubing 630 can be any type of material capable of providing structure or support but flexible enough to navigate a wellbore, such as metal, plastic, or hybrid materials.

Inflatable packers 620 can be attached to isolation cable 230. Inflatable packers 620 can be any type of packers capable of expanding downhole to stabilize isolation cable 230 within completion sheath 300. Expanding inflatable packers 620 can stabilize fiber optic cable 600. Inflatable packers 620 can be arranged at regular intervals along the length of the isolation cable 230, with the total number determined by the length of wellbore 30. Inflatable packers 620 can expand while the tool is positioned in the wellbore. In at least one embodiment, inflatable packers 620 are expanded by hydraulic means controlled at the surface.

The materials of construction of one-stage drilling tool 100 can be any type of materials that are resistant to the temperatures, pressures, debris and vibrations experienced within a formation and during a drilling operations.

In one method, one-stage drilling tool 100 can be used to drill a wellbore. Control optics 250 can be designed and selected to produce shaped beam 14 having a divergent shape, resulting in drilling beam 50 having a divergent shape. The diameter of base 410 can be designed to achieve the desired wellbore diameter, where the desired diameter is determined based on the needs of the formation.

One-stage drilling tool 100 can be placed in a wellbore starting point of formation 40. The wellbore starting point can be formed by conventional drilling methods or by any other methods of creating a starting point for a wellbore. Completion sheath 300 can be selected based on the needs of the wellbore. Laser unit 20 located on the surface can be switched to the on position.

One-stage drilling tool 100 can be operated to produce drilling beam 50 from laser head 200. In at least one embodiment, drilling beam 50 can have a divergent shape, as described with reference to FIG. 4A and laser assembly 210 of laser head 200 can be designed such that the diameter of base 410 of drilling beam 50 is greater than the widest point of one-stage drilling tool 100. In at least one embodiment, drilling beam 50 can have a collimated shape, as described with reference to FIG. 4C, and laser assembly 210 of laser head 200 can be operated to direct drilling beam 50 at formation 40 in the pattern desired for wellbore 30. In at least one embodiment, where drilling beam 50 has a collimated shape, one-stage drilling tool 100 can be operated in a circular pattern defining wellbore 30.

When in place, drilling beam 50 can be initiated and directed toward the formation. The power of the laser of drilling beam 50 can sublimate formation 40.

One-stage drilling tool 100 can be propelled into formation 40 away from the surface by a mode of movement. The modes of movement for one-stage drilling tool 100 can include orientation nozzles 220, coiled tubing 630, or combinations of the same. Orientation nozzles 220 can be activated to discharge the control fluid. The activated orientation nozzles 220 can move one-stage drilling tool 100 in a corresponding direction. Examples of the corresponding direction include relative to central axis 500, into formation 40 away from the surface, and combinations of the same. Coiled tubing 630 can connect to laser unit 20. Coiled tubing 630 can move one-stage drilling tool 100 further into formation 40 away from the surface. Coiled tubing 630 can provide physical support for the weight of one-stage drilling tool 100.

One-stage drilling tool 100 can continue to drill wellbore 30 and can be propelled into formation 40 until a predetermined well length is achieved. The predetermined well length can be a measure of the length of wellbore 30 through formation 40 from the surface to the end point of wellbore 30. The predetermined well length can be determined based on the characterization of formation 40 or the location of fluids in formation 40. When the predetermined well length is achieved, one-stage drilling tool 100 can be turned off, such that drilling beam 50 stops operating. In at least one embodiment, inflatable packers 620 can be deflated and fiber optic cable 600 can be detached from laser head 200 and withdrawn from completion sheath 300 to the surface and laser head 200 can remain in wellbore 30.

Completion sheath 300 and formation 30 can then be perforated using a perforation method. Examples of perforation methods can include lasers and shaped charges. Perforating formation 30 and completion sheath 300 allows fluid to communicate between the formation and the interior of completion sheath 300.

Figure 7:
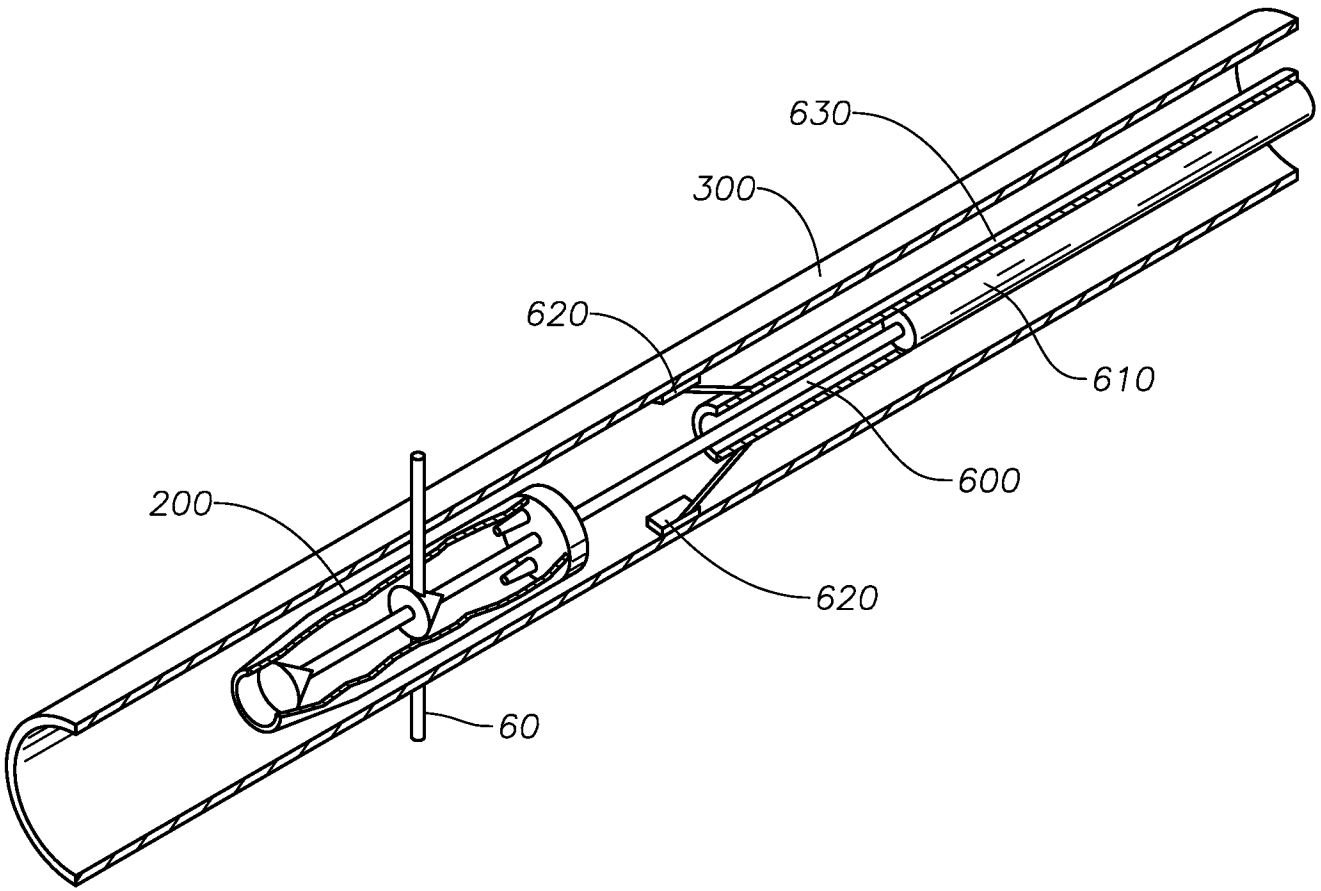
FIG. 7 is a sectional view of an embodiment of a one-stage drilling tool.

Referring to FIG. 7, an embodiment of one-stage drilling tool 100 is described with reference to FIG. 2C and FIG. 6. After completion sheath 300 is placed in the wellbore, laser head 200 is detached and withdrawn into the interior of completion sheath 300. At a predetermined position, laser head 200 can be operated to perforate completion sheath 300. Laser head 200 can be switched on to produce one or more side beam 60. Side beam 60 can be penetrate completion sheath 300 and into the formation, resulting in perforation of completion sheath 300. As laser head 200 moves within completion sheath 300, inflatable packers 620 can be deflated and re-inflated before operating later laser head 200.

In at least one embodiment, completion sheath 300 can be cemented in place after fiber optic cable 600 is removed and before a perforation method is deployed. Any cementing operation suitable to cement a completion sheath in place is suitable for use.

One-stage drilling tool 100 is in the absence of water jets useful for jet cutting or perforating a formation. The hole sizes and shapes created by jet cutting differ from the hole sizes and shapes formed by lasers. The use of water jets in jet cutting can result in holes with irregular sizes and shapes, because jet cutting cannot be used to create focused openings like can be produced with a laser. When water jets are used to cut a wellbore, it can result in a wellbore that is of irregular which can make putting the casing in place difficult and may require re-drilling. In addition, the use of jet cutting can result in the formation of debris in the wellbore that can damage the formation and the jetting tool.

One-stage drilling tool 100 contains only one fiber optic cable for delivering a single laser beam to the wellbore, because a single laser beam has greater power than a laser fractured into multiple beams.

Although the embodiments have been described in detail, it should be understood that various changes, substitutions, and alterations can be made hereupon without departing from the principle and scope. Accordingly, the scope of the embodiments should be determined by the following claims and their appropriate legal equivalents.

There various elements described can be used in combination with all other elements described here unless otherwise indicated.

The singular forms "a", "an" and "the" include plural referents, unless the context clearly dictates otherwise.

Optional or optionally means that the subsequently described event or circumstances may or may not occur. The description includes instances where the event or circumstance occurs and instances where it does not occur.

Ranges may be expressed here as from about one particular value to about another particular value or between about one particular value and about another particular value and are inclusive unless otherwise indicated. When such a range is expressed, it is to be understood that another embodiment is from the one particular value to the other particular value, along with all combinations within said range.

As used here and in the appended claims, the words "comprise," "has," and "include" and all grammatical variations thereof are each intended to have an open, non-limiting meaning that does not exclude additional elements or steps.

That which is claimed is:

1. A method of drilling a wellbore that traverses a formation, the method comprising the steps of:

inserting a one-stage drilling tool into the wellbore, the one-stage drilling tool comprising:

a laser head, the laser head configured to produce a drilling beam, a completion sheath, the completion sheath configured to line the wellbore, and a centralizer, the centralizer configured to support the completion sheath within the wellbore;

operating the laser head to produce the drilling beam, wherein the drilling beam comprises a laser, wherein the drilling beam has a focused shape, the focused shape comprising a base proximate to the front end of the laser head and an apex at a distance from a front end of the laser head, wherein a diameter of the apex of the drilling beam is less than a diameter of the one-stage drilling tool;

drilling the formation with the drilling beam, wherein the laser of the drilling beam is operable to sublimate the formation;

reaching a predetermined well length;

concluding operation of the drilling beam;

detaching an isolation cable from the laser head, wherein the isolation cable comprises a fiber optic cable; and retrieving the isolation cable from the completion sheath, wherein the completion sheath and the laser head remain fixed in the wellbore.

2. The method of claim 1, further comprising the step of propelling the one-stage drilling tool into the formation by a mode of movement, wherein the mode of movement of the one-stage drilling tool is selected from the group consisting of orientation nozzles, coiled tubing, and combinations of the same, wherein the drilling beam is configured to continuously sublimate the formation as the one-stage drilling tool is propelled into the formation.

3. The method of claim 1, further comprising the steps of:

producing a laser beam in a laser unit, the laser unit positioned on a surface of earth near the wellbore;

conducting the laser beam from the laser unit to the laser head through an isolation cable, wherein the isolation cable comprises a fiber optic cable, wherein the fiber optic cable is configured to conduct the laser beam from the laser unit to the laser head, wherein the isolation cable runs through the completion sheath from the laser unit to the laser head; and manipulating the laser beam in a laser assembly of the laser head to produce the drilling beam, wherein the laser assembly comprises one or more lenses.

4. The method of claim 3, wherein the isolation cable further comprises inflatable packers, wherein the inflatable packers are configured to stabilize the isolation cable in the completion sheath.

5. The method of claim 3, further comprising the step of:

perforating the completion sheath with a perforation method, where the perforation method is selected from the group consisting of a laser and shaped charges.

6. The method of claim 1, further comprising the steps of:

activating one or more orientation nozzles situated around a laser assembly of the laser head by discharging a control fluid;

discharging the control fluid from one or more of the orientation nozzles, wherein the discharge of the control fluid is configured to provide thrust to the one-stage drilling tool; and moving the laser head, wherein the thrust provided by the control fluid is operable to move the one-stage drilling tool in a corresponding direction.

7. The method of claim 6, wherein the corresponding direction is selected from the group consisting of relative to a central axis, into the formation away from a surface, and combinations of the same.

8. A method of drilling a wellbore that traverses a formation, the method comprising the steps of:

inserting a one-stage drilling tool into the wellbore, the one-stage drilling tool comprising:

a laser head, the laser head configured to produce a drilling beam, a completion sheath, the completion sheath configured to line the wellbore, and a centralizer, the centralizer configured to support the completion sheath within the wellbore;

operating the laser head to produce the drilling beam, wherein the drilling beam comprises a laser, wherein the drilling beam has a collimated shape, the collimated shape comprising a constant diameter upon exiting the one-stage drilling tool;

drilling the formation with the drilling beam, wherein the laser of the drilling beam is operable to sublimate the formation;

reaching a predetermined well length;

concluding operation of the drilling beam;

detaching an isolation cable from the laser head, wherein the isolation cable comprises a fiber optic cable; and retrieving the isolation cable from the completion sheath, wherein the completion sheath and the laser head remain fixed in the wellbore.

9. The method of claim 8, further comprising the step of propelling the one-stage drilling tool into the formation by a mode of movement, wherein the mode of movement of the one-stage drilling tool is selected from the group consisting of orientation nozzles, coiled tubing, and combinations of the same, wherein the drilling beam is configured to continuously sublimate the formation as the one-stage drilling tool is propelled into the formation.

10. The method of claim 8, further comprising the steps of:

producing a laser beam in a laser unit, the laser unit positioned on a surface of earth near the wellbore;

conducting the laser beam from the laser unit to the laser head through an isolation cable, wherein the isolation cable comprises a fiber optic cable, wherein the fiber optic cable is configured to conduct the laser beam from the laser unit to the laser head, wherein the isolation cable runs through the completion sheath from the laser unit to the laser head; and manipulating the laser beam in a laser assembly of the laser head to produce the drilling beam, wherein the laser assembly comprises one or more lenses.

11. The method of claim 10, wherein the isolation cable further comprises inflatable packers, wherein the inflatable packers are configured to stabilize the isolation cable in the completion sheath.

12. The method of claim 10, further comprising the step of:

perforating the completion sheath with a perforation method, where the perforation method is selected from the group consisting of a laser and shaped charges.

13. The method of claim 8, further comprising the steps of:

activating one or more orientation nozzles situated around a laser assembly of the laser head by discharging a control fluid;

discharging the control fluid from one or more of the orientation nozzles, wherein the discharge of the control fluid is configured to provide thrust to the one-stage drilling tool; and moving the laser head, wherein the thrust provided by the control fluid is operable to move the one-stage drilling tool in a corresponding direction.

14. The method of claim 13, wherein the corresponding direction is selected from the group consisting of relative to a central axis, into the formation away from a surface, and combinations of the same.

15. A method of drilling a wellbore that traverses a formation, the method comprising the steps of:

inserting a one-stage drilling tool into the wellbore, the one-stage drilling tool comprising:

a laser head, the laser head configured to produce a drilling beam, wherein the laser lead comprises a laser assembly, wherein the laser assembly comprises:

a splitter, the splitter configured to separate the laser beam into multiple beams, wherein the splitter comprises a prism, and an exit lens, the exit lens configured to manipulate a straight-through beam to produce the drilling beam, a completion sheath, the completion sheath configured to line the wellbore, and a centralizer, the centralizer configured to support the completion sheath within the wellbore;

operating the laser head to produce the drilling beam, wherein the drilling beam comprises a laser, wherein the drilling beam has a shape selected from a divergent shape, a focused shape, and a collimated shape;

drilling the formation with the drilling beam, wherein the laser of the drilling beam is operable to sublimate the formation;

reaching a predetermined well length;

concluding operation of the drilling beam;

detaching the laser head;

withdrawing the laser head into the interior of the completion sheath to a predetermined position;

operating the laser head to produce one or more side beams in the splitter of the laser assembly, wherein the one or more side beams penetrate the completion sheath and into the formation such that the completion sheath is perforated;

detaching an isolation cable from the laser head after the completion sheath is perforated, wherein the isolation cable comprises a fiber optic cable; and retrieving the isolation cable from the completion sheath, wherein the completion sheath and the laser head remain fixed in the wellbore.

16. The method of claim 15, further comprising the step of propelling the one-stage drilling tool into the formation by a mode of movement, wherein the mode of movement of the one-stage drilling tool is selected from the group consisting of orientation nozzles, coiled tubing, and combinations of the same, wherein the drilling beam is configured to continuously sublimate the formation as the one-stage drilling tool is propelled into the formation.

17. The method of claim 15, further comprising the steps of:

producing a laser beam in a laser unit, the laser unit positioned on a surface of earth near the wellbore;

conducting the laser beam from the laser unit to the laser head through an isolation cable, wherein the isolation cable comprises a fiber optic cable, wherein the fiber optic cable is configured to conduct the laser beam from the laser unit to the laser head, wherein the isolation cable runs through the completion sheath from the laser unit to the laser head; and manipulating the laser beam in the laser assembly of the laser head to produce the drilling beam.

18. The method of claim 17, wherein the isolation cable further comprises inflatable packers, wherein the inflatable packers are configured to stabilize the isolation cable in the completion sheath.

19. The method of claim 15, further comprising the steps of:

activating one or more orientation nozzles situated around a laser assembly of the laser head by discharging a control fluid;

discharging the control fluid from one or more of the orientation nozzles, wherein the discharge of the control fluid is configured to provide thrust to the one-stage drilling tool; and moving the laser head, wherein the thrust provided by the control fluid is operable to move the one-stage drilling tool in a corresponding direction.

20. The method of claim 19, wherein the corresponding direction is selected from the group consisting of relative to a central axis, into the formation away from a surface, and combinations of the same.

* * * * *